United States Patent [19]

Levine

[11] Patent Number: 4,972,922

[45] Date of Patent: Nov. 27, 1990

[54] ADJUSTABLE SCAFFOLDING ASSEMBLY

[76] Inventor: Bernard G. Levine, 224 Kettle Creek Rd., Toms River, N.J. 08753

[21] Appl. No.: 442,519

[22] Filed: Nov. 28, 1989

[51] Int. Cl.[5] ..... E06C 7/14; E06C 7/48; E06C 1/397

[52] U.S. Cl. ..... 182/45; 182/103; 182/116; 182/214

[58] Field of Search ..... 182/214, 206, 107, 103, 182/102, 45, 116, 120, 121

[56] References Cited

U.S. PATENT DOCUMENTS

| | | | |
|---|---|---|---|
| 444,280 | 1/1891 | Pepin | 182/103 |
| 800,896 | 10/1905 | Biehler | 182/103 |
| 2,934,163 | 4/1960 | Ladewski | 182/214 |
| 3,115,211 | 12/1963 | Ostrander | 182/103 |
| 4,232,759 | 11/1980 | Jacobs | 182/39 |
| 4,643,274 | 2/1987 | Tataseo | 182/214 |
| 4,646,877 | 3/1987 | Whan | 182/38 |
| 4,754,843 | 7/1988 | Anderson | 182/214 |

*Primary Examiner*—Reinaldo P. Machado
*Attorney, Agent, or Firm*—H. Jay Spiegel

[57] ABSTRACT

The present invention relates to an improved adjustable scaffolding assembly and is seen to include an adjustable scaffolding supporting device, a roller assembly, and a peak stabilizer bar assembly. The adjustable scaffolding supporting device is adapted to be slid along a ladder to permit positioning the scaffolding supporting device at a predetermined height and pitch with respect to the ladder. The roller assembly is mountable to the ladder and facilitates positioning the scaffolding assembly for use. The peak stabilizer bar assembly is also mountable to the ladder and is adapted to secure the scaffolding assembly while in position on a building roof.

8 Claims, 6 Drawing Sheets

FIG. 1
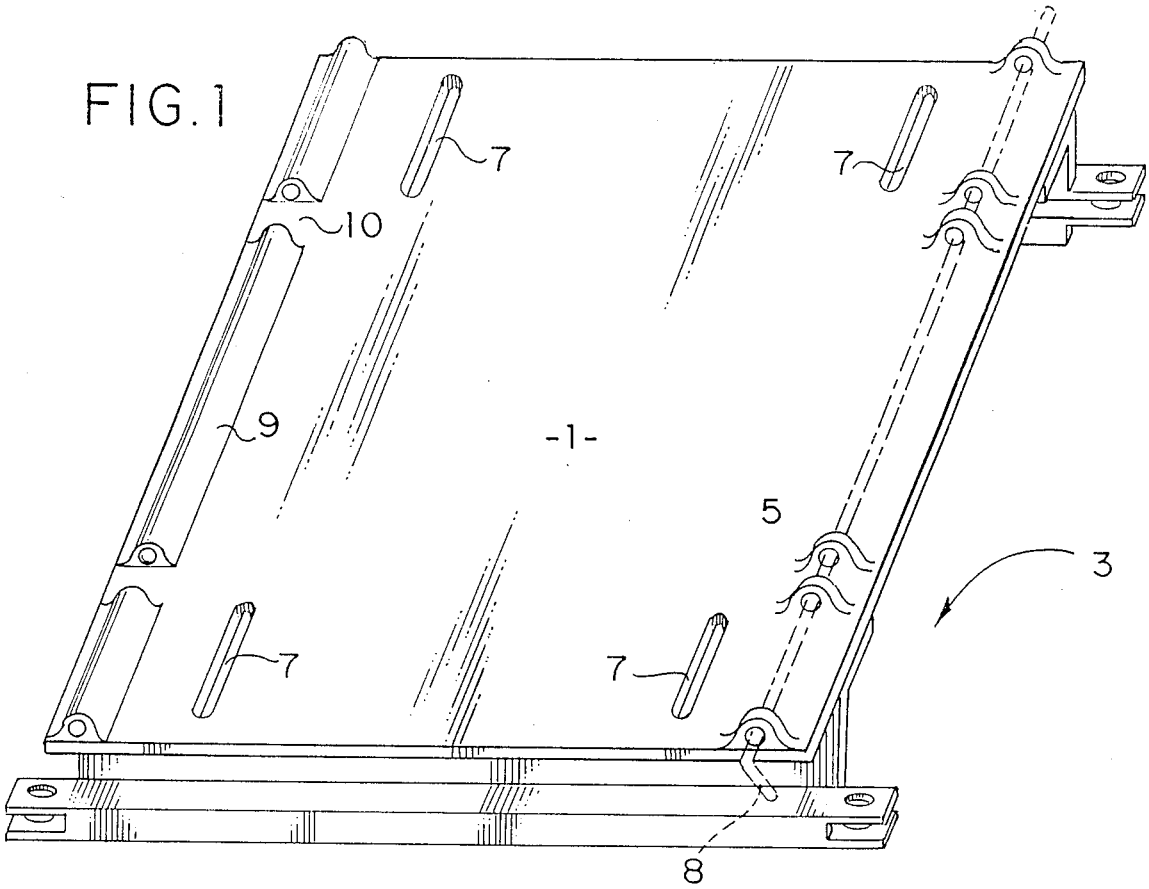
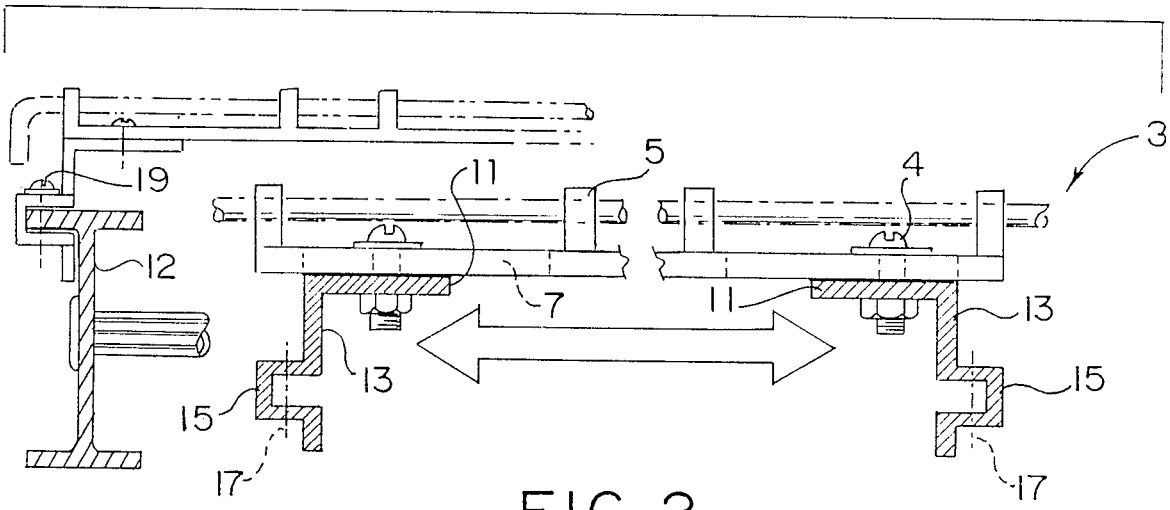
FIG. 2

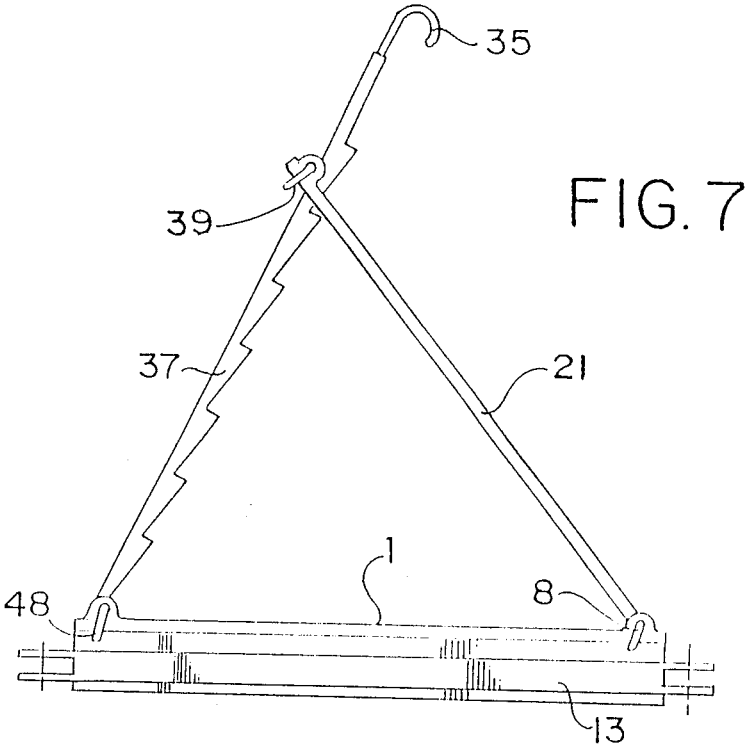
FIG. 7
FIG. 8
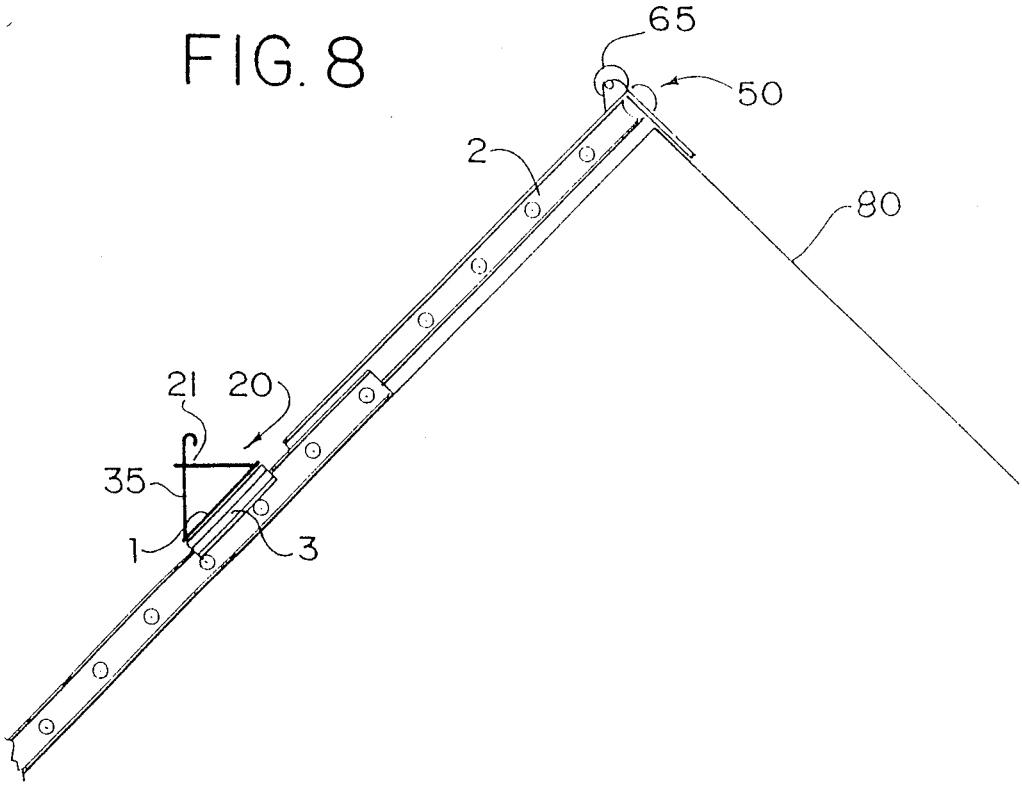

FIG. 9
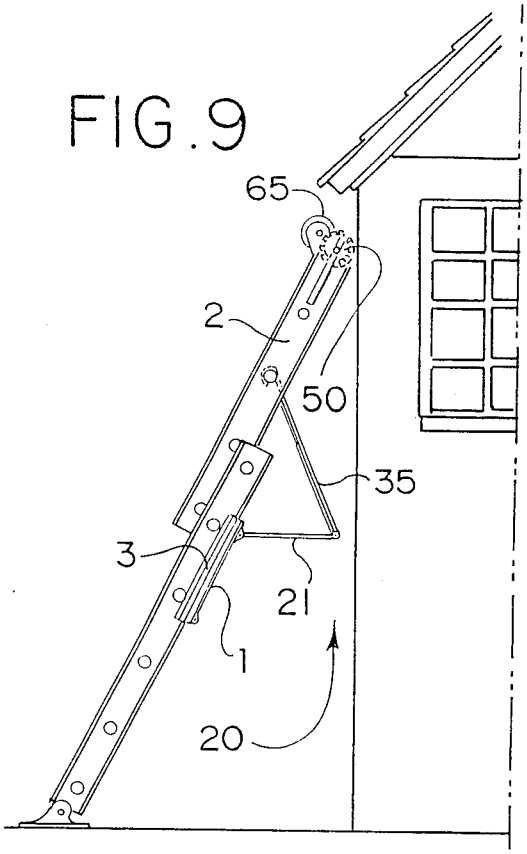
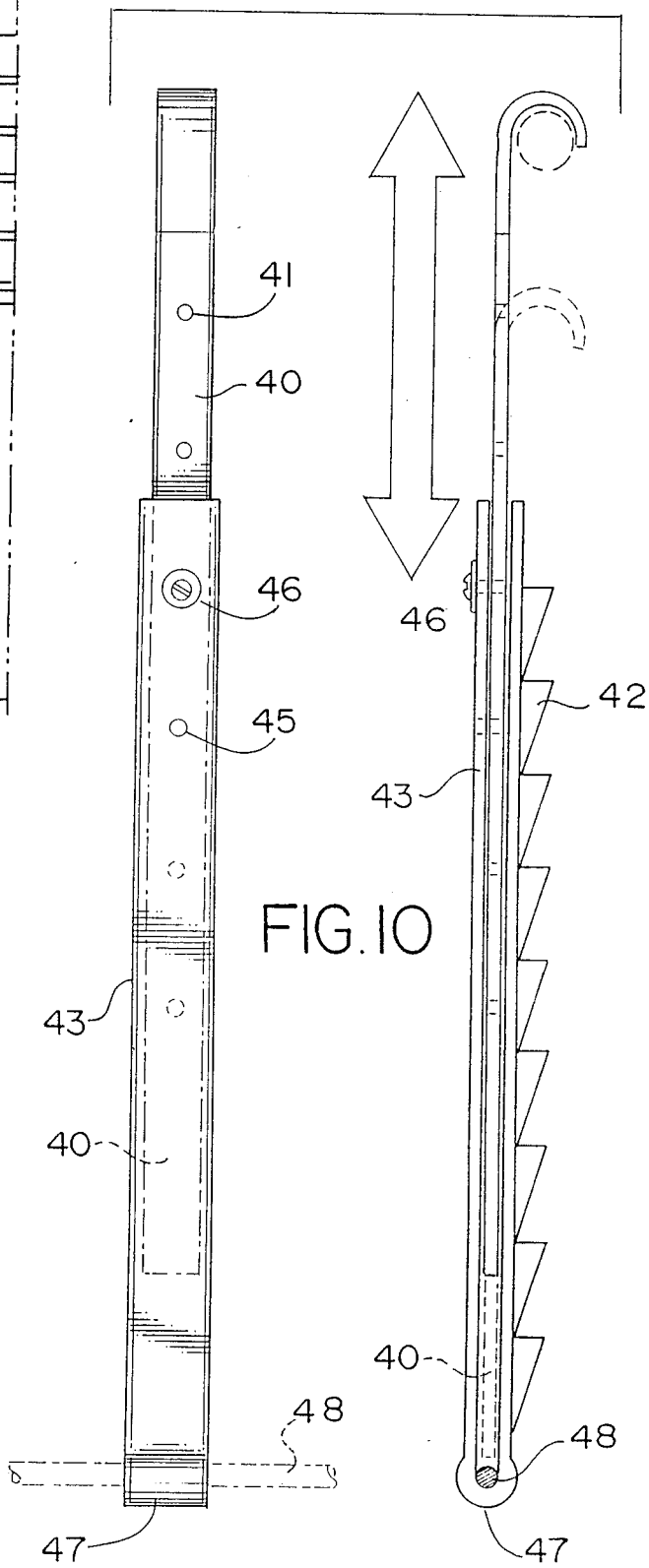
FIG. 10

ADJUSTABLE SCAFFOLDING ASSEMBLY

BACKGROUND OF THE INVENTION

The present invention relates to an improved adjustable scaffolding assembly. In the prior art, the concept of an adjustable scaffold mechanism is known. However, Applicant is unaware of any prior art that teaches or suggests all of the features of the present invention, including an adjustable scaffolding support device that includes adjustable features with respect to height as well as pitch. The following United States Patents are known to Applicant:

U.S. Pat. No. 4,232,759 to Jacobs discloses the concept of a mobile ladder-scaffolding system which engages a roof and is horizontally movable with respect to the roof that the scaffolding system is attached thereto. Of course, this patent does not include all of the features of the present invention including an adjustable scaffolding support device that permits adjustment with respect to the height of the scaffold as well as the pitch thereof.

U.S. Pat. No. 4,646,877 to Whan discloses a wheeled scaffold that is capable of moving across a roof while carrying roofing materials. The teachings of this patent do not include all of the features of the present invention including an adjustable scaffolding assembly that may be utilized on a roof or other parts of a building structure.

SUMMARY OF THE INVENTION

The present invention relates to an improved adjustable scaffolding assembly that may be utilized while working on a structure's roof or other building structure portion. The present invention includes the following interrelated aspects and features:

(a) In a first aspect, the present invention includes a ladder having a peak stabilizer bar mounted thereon, a roller assembly mounted thereon, and a scaffold supporting device that may be slid along the legs of the ladder.

(b) Also included as a part of the scaffold supporting device that is adapted to slide along the ladder is a base plate that has ladder guides that are adjustable in height and width to accommodate sliding the base plate along the legs of a ladder as well as accommodating ladders of different widths.

(c) The scaffold supporting device also includes a top plate that is pivotally mountable on the base plate by insertion of a pin through pin retaining portions located on both the top plate and the base plate. Also included as a part of the scaffold supporting device are adjustable braces that are pivotally mountable on the base plate and capable of securing the top plate at a desired pitch. The adjustable braces also have a hook portion thereon that may be used to secure the scaffold supporting device to the rungs of a ladder.

(d) The ladder also includes a roller assembly that is mounted on the top portion of the ladder and is utilized i sliding the improved adjustable scaffolding assembly along a roof surface.

(e) In conjunction with the ladder is a peak stabilizer bar assembly that is also attached to the end portion of the ladder and operates to secure and support the improved adjustable scaffolding assembly on a roof by engaging the peak of the roof with the peak stabilizer bar.

Accordingly, it is a first object of the present invention to provide an improved adjustable scaffolding assembly.

It is a further object of the present invention to provide an adjustable scaffolding assembly that may be utilized on a structure's roof as well as other portions of a structure.

It is a yet further object of the present invention to provide an improved adjustable scaffolding assembly that includes a scaffolding support device that is adjustable in height as well as pitch.

These and other objects, aspects and features of the present invention will be better understood from the following detailed description of the preferred embodiment when read in conjunction with the appended drawing figures.

BRIEF DESCRIPTION OF THE DRAWINGS

FIG. 1 shows a perspective view of the base plate of the scaffolding supporting device of the present invention.

FIG. 2 shows a side view of the base plate shown in FIG. 1.

FIG. 7 shows a side view of the scaffolding supporting device shown in FIG. 5.

FIG. 8 shows a side view of the improved adjustable scaffolding assembly in a first exemplary use.

FIG. 9 shows a side view of the improved adjustable scaffolding assembly in a second exemplary use.

FIG. 10 shows the adjustable braces of the scaffolding supporting device in greater detail.

SPECIFIC DESCRIPTION OF THE PREFERRED EMBODIMENTS

Figure 3:
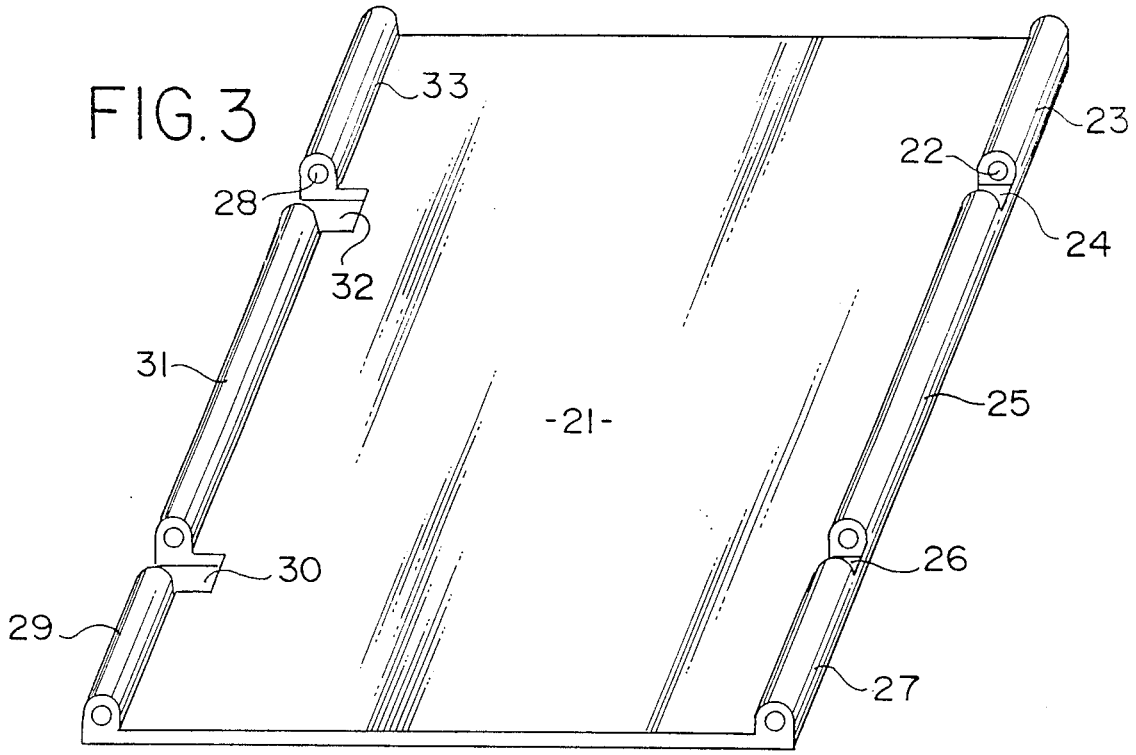
FIG. 3 shows a perspective view of the top plate of the scaffolding supporting device of the present invention.

With reference, firstly, to FIG. 1, the base plate of the scaffolding supporting device is shown in perspective and is seen to include the base plate 1 having on its top surface a plurality of first pin retaining members 5 on one end and a plurality of second pin retaining members 9 on the opposite end. The pin retaining members 5 are adapted to receive a locking pin 8 (shown in cross-hatch) to secure other elements of the scaffolding supporting device to be described hereinafter. The base plate 1 also contains openings 7 which permit the ladder guides 3 to be horizontally adjusted for differing ladder widths. Also illustrated in FIG. 1 is opening 10 between pin retaining members 9 which is adapted to receive the adjustable braces (not shown) to be described hereinafter. FIG. 2 shows a cross-section of the base plate of FIG. 1 and more clearly illustrates the ladder guide assembly 3 as attached to the base plate 1. The ladder guide assembly 3 is seen to include a first leg 11 which is secured to the base plate 1 by nut and bolt assembly 4 in the openings 7. The ladder guide assembly 3 also includes a second leg 13 which has an extending portion 15 which is adapted to receive a portion of a ladder leg 12 to permit the ladder guide assembly to slide along the ladder during positioning of the scaffolding supporting device. End portion 15 of the ladder guide 3 has an opening 17 which may receive a locking pin 19 which acts to secure the ladder guide assembly 3 onto the ladder leg 12 to prevent any sliding or slippage once the position of the scaffolding supporting device is determined. The ladder guide portion 15 has openings above and below such that two locking pins 19 may be used to secure the ladder guide assembly onto the ladder leg 12. The ladder guide assembly 3 may be horizontally adjusted for differing ladder widths by sliding the assembly 3 in the opening 7 as indicated by the arrow in FIG. 2 and then securing the position of the assembly 3 by tightening the nut and bolt assembly 4.

FIG. 3 illustrates a perspective view of another portion of the scaffolding supporting device and is seen to include the top plate 21 having on its top surface a plurality of pin retaining members 23, 25 and 27 each having an opening 22 therein for receiving a pin and openings 24 and 26, these openings adapted to receive the adjustable braces as described hereinafter. On the opposite end of top plate 21 are three pin retaining members 29, 31 and 33 which are also adapted to receive a pin through the opening 28. On this end of the top plate 21 are two openings 30 and 32 which are adapted to receive portions of the adjustable braces when the top plate 21 is in a particular configuration.

Figure 4:
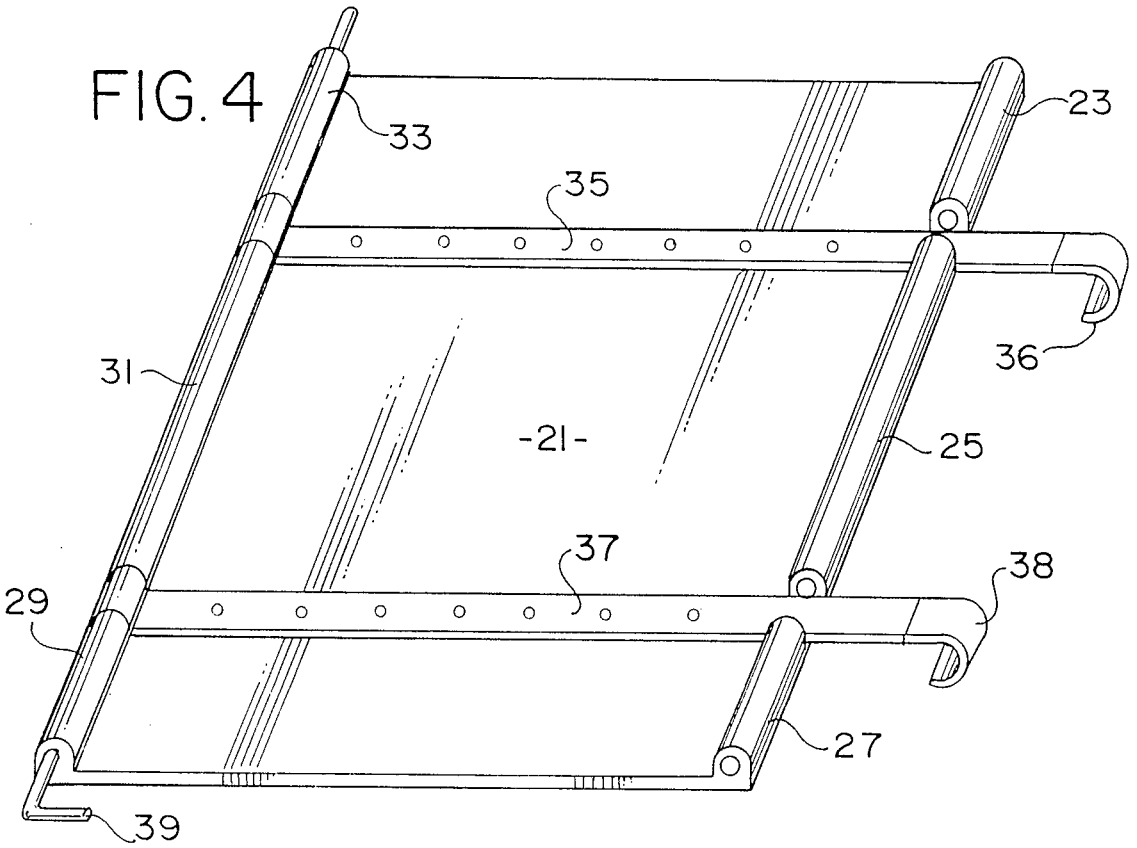
FIG. 4 shows a perspective view of the top plate of the scaffolding supporting device with the adjustable braces in a stored position.

FIG. 4 shows a perspective view of the top plate 21, as shown in FIG. 3, and is seen to further include adjustable braces 35 and 37 having the hook portions 36 and 38, respectively, thereon, the adjustable braces connected to the top plate 21 by the pin 39. The adjustable braces 35 and 37 are depicted in this drawing in the position for storing the adjustable braces when the scaffolding supporting device is not in use.

Figure 5:
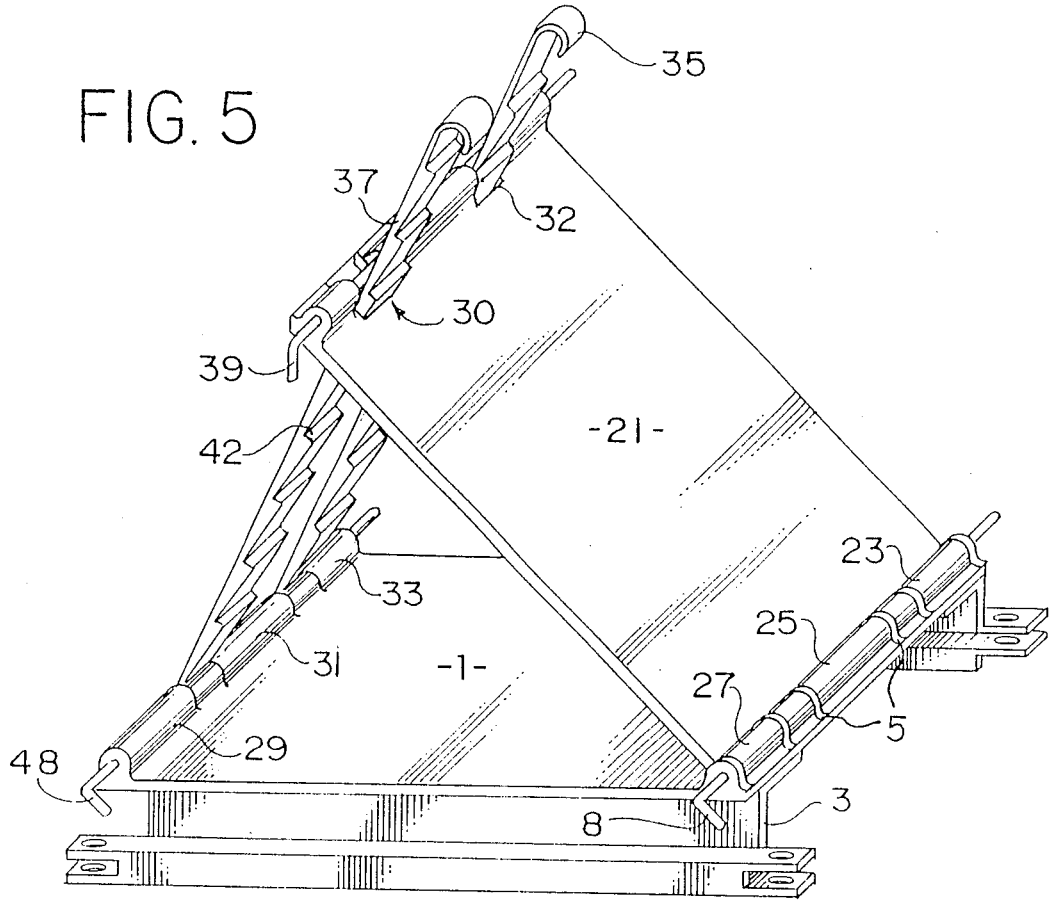
FIG. 5 shows a perspective view of the scaffolding supporting device in an exemplary configuration.

FIG. 5 shows a perspective view of the scaffolding supporting device including the base plate 1, the top plate 21, and the adjustable braces 35 and 37. As can be seen from the drawing, the top plate 21 is pivotally connected to the base plate 1 by insertion of the pin 8 through pin retaining members 23, 25 and 27 of the top plate 21 and pin retaining members 5 of the bottom plate 1. The adjustable braces 35 and 37 are secured to the base plate 1 by insertion of the pin 48 through pin retaining members 29, 31 and 33 and adjustable braces 35 and 37. The pitch of top plate 21 is determined by engaging adjustable braces 35 and 37 into the openings 30 and 32 in the top plate 21 and securing the adjustable braces 35 and 37 by insertion of the locking pin 39 through pin retaining members 29, 31 and 33.

Figure 6:
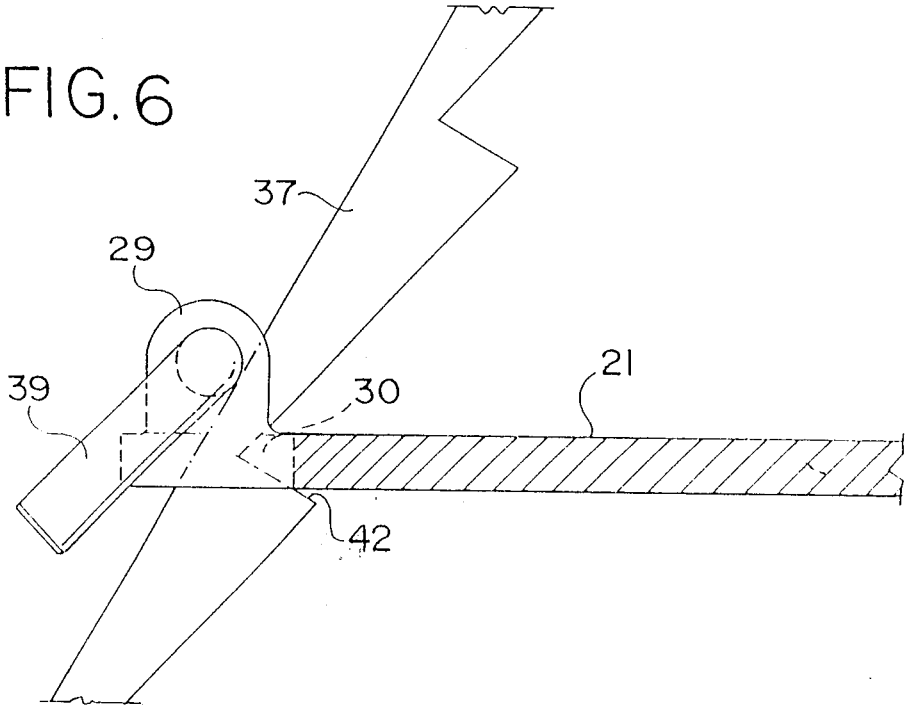
FIG. 6 shows an enlarged detail of the adjustable brace supporting the top plate of the scaffolding supporting device.

FIG. 6 more clearly illustrates the manner in which the adjustable braces are engaged with the top plate 21. The top plate 21 is raised until a predetermined pitch is reached and the end portion of top plate 21 is placed against step portion 42 of the adjustable brace 37. Once the top plate 21 is secured against the adjustable brace 37, the locking pin 39 is inserted into pin retaining portion 29 to prevent the adjustable brace 37 from slipping out of opening 30 in the top plate 21. The pitch of the top plate 21 may be changed merely by removing locking pin 39 and placing the end portion of the top plate 21 on another step portion of the adjustable brace 37 and securing the adjustable brace 37 by reinsertion of locking pin 39 into pin retaining portion 29.

FIG. 7 shows a side view of the scaffolding supporting device more clearly depicting the configuration of base plate 1, top plate 21, and adjustable brace 37.

FIG. 8 shows a side view of an exemplary use of the improved adjustable scaffolding assembly when used on a roof. As can be seen from the drawing, the improved adjustable scaffolding assembly includes the scaffolding supporting device 20 which is seen to include base plate 1 with ladder guides 3 attached thereto, adjustable brace 35, and top plate 21. Also included in the adjustable scaffolding assembly is the roller assembly 65 and peak stabilizer bar assembly 50, both roller assembly 65 and peak stabilizer bar assembly 50 mounted to an extension ladder 2. In this particular use of the improved adjustable scaffolding device, the peak stabilizing bar 50 is configured to attach to the peak of roof 80 so as to support the adjustable scaffolding assembly during use. The roller assembly 65 facilitates installing the improved adjustable scaffolding assembly on a roof by permitting a user to roll the ladder up the incline of the roof using the roller assembly 65 and then having the user turn the ladder 180 degrees to permit engagement of the peak stabilizer bar 50 with the roof peak. The scaffolding supporting device 20 is shown with top plate 21 attached to adjustable brace 35 to support a scaffold (not shown) in a position parallel to the ground to permit a person to conveniently work while on the roof 80. Alternatively, a user may utilize the top plate 21 as a scaffold to work while on the roof.

FIG. 9 shows another exemplary use of the improved adjustable scaffolding assembly against the side wall of a building structure. In this configuration, the base plate 1 is attached using the ladder guide 3 to the underside of the extension ladder 2 with the top plate 21 pivotally connected to one end of the base plate 1. The adjustable brace 35 is then pivotally connected to the other end of the top plate 21 and hooked onto a rung of the extension ladder 2 so as to configure the top plate 21 in an orientation parallel with respect to the ground. In this exemplary use, a user of the improved adjustable scaffolding assembly may install a scaffold resting on the top plate 21 to permit access to the side wall of the structure.

FIG. 10 shows a more detailed illustration of the adjustable brace 35 and 37. As can be seen from the drawing, the adjustable brace has an inner leg 40 having openings 41 therein and an outer leg portion 43 having a plurality of corresponding openings 45 therein. One end portion of outer leg 43 has a rounded portion 47 which is adapted to receive a locking pin 48 to secure the adjustable brace into either the top plate or the base plate. The length of the adjustable brace may be adjusted by aligning the openings 41 in the inner leg 40 and the openings 45 in the outer leg 43 and securing the length of the adjusted brace by pin 46. This adjustable feature allows the pitch of the top plate 21 as depicted in FIG. 9 to be adjusted depending on the specific height of the rung of the ladder that the adjustable brace is to be hooked upon.

Figure 11:
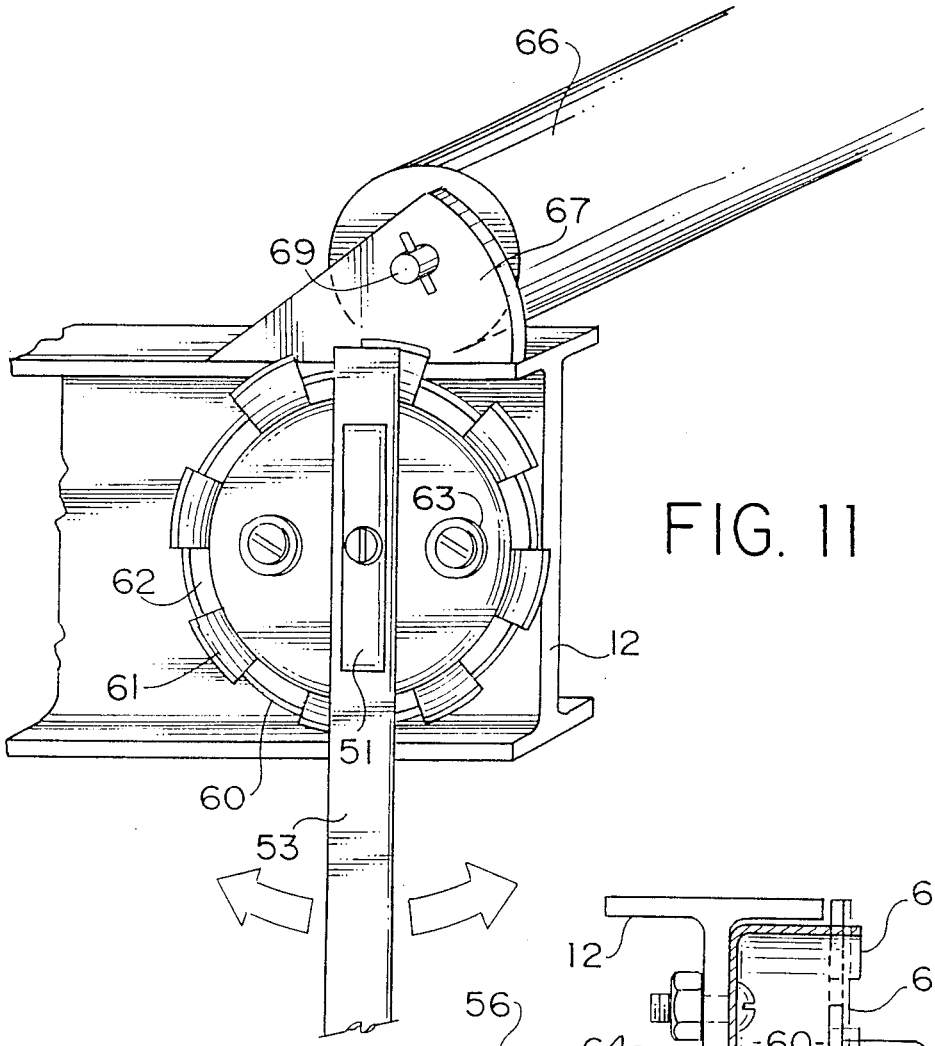
FIG. 11 shows a perspective view of the roller bar assembly and peak stabilizer bar assembly of the present invention.
Figure 12:
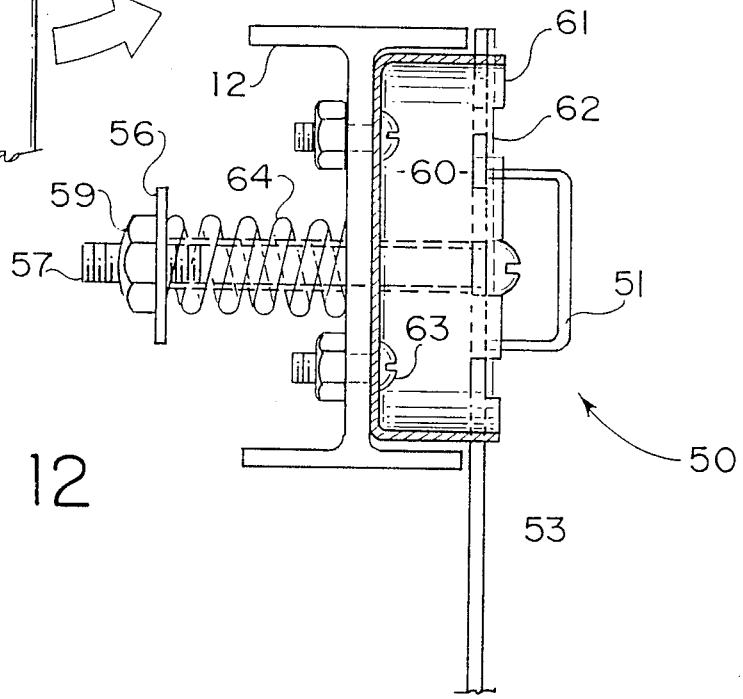
FIG. 12 shows a side view of the peak stabilizer bar assembly of the present invention.

FIGS. 11 and 12 illustrate the roller assembly 65 and peak stabilizer bar assembly 50 of the present invention. As can be seen in FIG. 11, the roller assembly 65 includes a roller 66, a roller retaining member 67 which is mountable to the ladder 2, and a roller shaft-pin assembly 69 which acts to retain the roller in member 67. Referring to both FIGS. 11 and 12, the peak stabilizer bar assembly 50 is seen to include the peak stabilizer bar 53 having a handle 51 attached thereon, a bar retaining cylinder 60 having an extended peripheral portion 61 and an indented peripheral opening 62, a threaded shaft 57, a spring means 64, a nut and washer 59 and 56, respectively, and nut and bolt assembly 63. The bar retaining cylinder 60 is secured to the ladder leg 12 by the nut and bolt assembly 63. The peak stabilizer bar 53 is secured by action of the spring 64 compressing between the ladder leg 12 and washer 56 and the peak stabilizer bar 53 fitting into indented opening 62 of the peripheral edge of cylinder 60. In operation, the peak stabilizer bar is extended by a user pulling on the handle 51 and compressing the spring 64 to allow the peak stabilizer bar 53 to be rotated to a predetermined position. Once the predetermined position has been located, the peak stabilizer bar 53 is allowed to be retracted by expansion of the spring 64, wherein the peak stabilizer bar is inserted into aligned opening 62 in the bar retaining cylinder 60.

Referring again to FIGS. 8 and 9, the peak stabilizer bar 53 may be positioned to stabilize the adjustable scaffolding assembly on the peak of a roof 80, as shown in FIG. 8, or, the peak stabilizer bar 53 may be retracted into a position parallel with the ladder 2, as shown in FIG. 9, to permit the adjustable scaffolding assembly to be used against the side wall of a structure.

The improved adjustable scaffolding assembly of the present invention permits a user to adjust the position of the scaffolding support device by sliding the device along the length of a ladder. The scaffolding supporting device also permits the pitch of the top plate of the device to be adjusted to accommodate the pitch of the ladder as positioned on or against a building or a building component. The adjustable width feature of the ladder guides also facilitates using the scaffolding supporting device with a single ladder or an extension ladder. The scaffolding supporting device may be directly slid up a single ladder to a desired height, or, in the case of an extension ladder, the ladder guides may be adjusted for both widths of each ladder of the extension ladder such that the scaffolding supporting device may be slid along either ladder. Additionally, the pivotal connections of the various segments of the scaffolding supporting device permit compact storage, as well as portability and adaptability to various ladder sizes.

As such, an invention has been disclosed in terms of a preferred embodiment thereof which fulfils each and every one of the objects of the present invention as set forth hereinabove and provides a new and improved adjustable scaffolding assembly of great utility and novelty.

Of course, various changes, modifications, and alterations in the teachings of the present invention may be contemplated by those skilled in the art without departing from the intended spirit and scope thereof. As such, it is intended that the present invention only be limited by the terms of the appended claims.

I claim:

1. A scaffold device comprising:

(a) a base plate;

(b) a pair of ladder guides removably attachable to said base plate, each said ladder guide horizontally and vertically adjustable with respect to said base plate, said ladder guides being adapted to slide along the legs of a ladder;

(c) a top plate;

(d) a pair of adjustable braces;

(e) wherein said base plate and said top plate are pivotally connectable; and, (f) wherein each said adjustable brace is pivotally connectable to said top plate and said base plate.

2. The invention of claim 1, further including a ladder.

3. The invention of claim 1, further including a peak stabilizing bar assembly, said peak stabilizing bar assembly further comprising:

(a) a bar;

(b) a hollow cylinder having a base at one end thereof, said hollow cylinder having means for retaining said bar in a fixed position;

(c) means for permitting said bar to be oriented into a said fixed position, and (d) means for removably attaching said base to a ladder.

4. The invention of claim 1, further including a roller assembly, said roller assembly further comprising:

(a) a roller; and (b) means to mount said roller across an end portion of a ladder, said roller assembly being adapted to permit a ladder to be rolled along a surface.

5. The invention of claim 3, further including a roller assembly, said roller assembly further comprising:

(a) a roller; and (b) means to mount said roller across an end portion of a ladder, said roller assembly being adapted to permit a ladder to be rolled along a surface.

6. The invention of claim 1, wherein each said adjustable brace further comprises:

(a) an inner leg having a plurality of first openings therein;

(b) an outer leg having a plurality of second openings therein;

(c) a hook portion on said inner leg;

(d) a pin retaining portion on one end of said outer leg; and (e) a pin for securing said inner leg within said outer leg at a given height by said pin being inserted through an aligned said first and said second opening.

7. The invention of claim 1, including a plurality of pins for pivotally connecting said top plate to said base plate and each said adjustable brace to said top plate or said base plate.

8. A stabilizing bar assembly comprising:

(a) a bar, said bar being adapted to engage a roof peak for stabilizing a ladder;

(b) a hollow cylinder having a base at one end thereof, said hollow cylinder having means for retaining said bar in a fixed position;

(c) means for permitting said bar to be orientated into a said fixed position, and (d) means for removably attaching said base to a said ladder;

(e) said hollow cylinder having a base being sized to fit between flanges of a leg of a said ladder such that said bar may be orientated parallel to said ladder and between said flanges for storage.

* * * * *